US007181954B2

(12) United States Patent
Horie

(10) Patent No.: US 7,181,954 B2
(45) Date of Patent: Feb. 27, 2007

(54) REFRIGERANT LEAK DETECTOR COMPRESSOR

(75) Inventor: Munehiro Horie, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 54 days.

(21) Appl. No.: 10/522,145

(22) PCT Filed: Mar. 10, 2003

(86) PCT No.: PCT/JP03/02817

§ 371 (c)(1),
(2), (4) Date: Jan. 24, 2005

(87) PCT Pub. No.: WO2004/016998

PCT Pub. Date: Feb. 26, 2004

(65) Prior Publication Data

US 2006/0162427 A1 Jul. 27, 2006

(30) Foreign Application Priority Data

Aug. 19, 2002 (JP) ..... 2002-238667

(51) Int. Cl.
*G01M 3/04* (2006.01)

(52) U.S. Cl. ..... 73/40.7; 73/40.5 R; 62/125

(58) Field of Classification Search ..... 73/40.7, 73/40.5; 63/125
See application file for complete search history.

(56) References Cited

U.S. PATENT DOCUMENTS 6,467,280 B2 * 10/2002 Pham et al. ..... 62/126
6,499,305 B2 * 12/2002 Pham et al. ..... 62/126
2005/0039469 A1 * 2/2005 Nonaka et al. ..... 62/129

FOREIGN PATENT DOCUMENTS

| | | | |
|---|---|---|---|
| JP | 03059371 A | * | 3/1991 |
| JP | 7-337081 | | 12/1995 |
| JP | 2001-165552 | | 6/2001 |
| JP | 2002039649 A | * | 2/2002 |
| JP | 2003214734 | | 7/2003 |

OTHER PUBLICATIONS

"International Search Report dated Jul. 1, 2003 for International Application No. PCT/JP03/02817."

* cited by examiner

*Primary Examiner*—Hezron Williams
*Assistant Examiner*—Ryan Christensen
(74) *Attorney, Agent, or Firm*—Pillsbury Winthrop Shaw Pittman, LLP

(57) ABSTRACT

A motor control unit 107 that controls a drive device 100 of a brushless DC motor 101 of a compressor 12 in a refrigerator 1 determines that a flammable refrigerant is not leaking when it is determined that a duty variation width A(t) of a duty value D(t) detected at a detection time t exceeds a reference duty variation width Aa of a duty value D(t0) measured at a duty measurement reference time t0 and a voltage value time rate-of-change ΔV of a voltage value V(t) of direct-current power exceeds a reference rate-of-change ΔVa.

8 Claims, 7 Drawing Sheets

REFRIGERANT LEAK DETECTOR COMPRESSOR

CROSS REFERENCE TO RELATED APPLICATION

This is the U.S. National Stage of PCT/JP03/002817, filed Mar. 10, 2003, which in turn claims priority to Japanese Patent Application No. 2002-238667, filed Aug. 19, 2002, both of which are incorporated herein in their entirety by reference.

TECHNICAL FIELD

The present invention relates to a refrigerant leak detector of a compressor of a refrigerator using a flammable refrigerant.

BACKGROUND ART

In a refrigerator using a flammable refrigerant such as isobutane, when the flammable refrigerant leaks from the refrigeration cycle, there is the potential for the leaking flammable refrigerant to ignite if the leaked concentration is within a flammable range and there is an ignition source nearby.

For this reason, an invention that detects flammable refrigerant leaks has been proposed. The invention reduces the danger of ignition of the flammable coolant by monitoring load variations in the refrigeration cycle when the drive circuit of a brushless DC motor driving the compressor is driven by an inverter motor drive by PWM control, so that when there is a specific load variation, it determines that there is a refrigerant leak and stops the power distribution with respect to parts such as electrical parts (e.g., Japanese Patent Application No. 2002-010817).

Namely, when a flammable refrigerant leaks from the refrigeration cycle of the refrigerator, the load of the compressor supplying the flammable refrigerant to a refrigerant flow path varies greatly. Thus, this load variation is determined by measuring the duty value of the PWM-controlled compressor, and it is determined that there is a flammable refrigerant leak when the rate-of-change of the duty value varies within a predetermined range.

However, with this invention, when a variation occurs in the direct-current power voltage supplying direct-current power to the compressor, the duty value changes without relation to the load variations in the refrigeration cycle, so that there is the potential to erroneously detect, from the change in the duty value, that there is a flammable refrigerant leak despite the fact that, in actuality, there is no flammable refrigerant leak.

Thus, in light of this problem, the present invention provides a refrigerant leak detector of a compressor that can prevent the erroneous detection of a flammable refrigerant leak even if the direct-current power voltage varies.

DISCLOSURE OF THE INVENTION

The invention of claim 1 is a refrigerant leak detector of a compressor, comprising: a compressor that compresses and supplies a flammable refrigerant to a refrigeration cycle of a refrigerator; a brushless DC motor that drives the compressor; a switching circuit that supplies drive signals to the brushless DC motor; control means that PWM-controls the switching circuit; direct-current power supplying means that supplies drive-use direct current power to the switching circuit; duty measuring means that measures the duty value of a PWM signal in the control means; drive value measuring means that measures drive values such as voltage, current and power relating to the direct-current power supplied by the direct-current power supplying means; duty determining means that determines whether or not the duty value measured by the duty measuring means exceeds a duty variation width where the duty value measured at a duty measurement reference time is used as a reference; drive value determining means that determines whether or not a time rate-of-change per unit time of the drive value measured at the drive value measurement reference time by the drive value measuring means exceeds a drive value reference rate-of-change; and refrigerant leak determining means which determines that the flammable refrigerant is leaking when it is determined in the duty determining means that the duty variation width has been exceeded and it is determined in the drive value determining means that the drive value reference rate-of-change has not been exceeded or which determines that the flammable refrigerant is not leaking when it is determined in the duty determining means that the duty variation width has been exceeded and it is determined in the drive value determining means that the drive value reference rate-of-change has been exceeded.

The invention of claim 2 is the refrigerant leak detector of a compressor of claim 1, wherein the duty measurement reference time and the drive value measurement reference time are set to different times.

The invention of claim 3 is a refrigerant leak detector of a compressor, comprising: a compressor that compresses and supplies a flammable refrigerant to a refrigeration cycle of a refrigerator; a brushless DC motor that drives the compressor; a switching circuit that supplies drive signals to the brushless DC motor; control means that PWM-controls the switching circuit; direct-current power supplying means that supplies drive-use direct current power to the switching circuit; duty measuring means that measures the duty value of a PWM signal in the control means; drive value measuring means that measures drive values such as voltage, current and power relating to the direct-current power supplied by the direct-current power supplying means; duty determining means that determines whether or not a time-of-rate change per unit time of the duty value measured at a duty measurement reference time by the duty measuring means exceeds a duty reference rate-of-change; drive value determining means that determines whether or not the drive value measured by the drive value measuring means exceeds a drive value variation width where a drive value measured at a drive value measurement reference time is used as a reference; and refrigerant leak determining means which determines that the flammable refrigerant is leaking when it is determined in the duty determining means that the duty time rate-of-change has been exceeded and it is determined in the drive value determining means that the drive value variation width has not been exceeded or which determines that the flammable refrigerant is not leaking when it is determined in the duty determining means that the duty time rate-of-change has been exceeded and it is determined in the drive value determining means that the drive value variation width has been exceeded.

The invention of claim 4 is the refrigerant leak detector of a compressor of claim 3, wherein the duty measurement reference time and the drive value measurement reference time are set to different times.

The invention of claim 5 is a refrigerant leak detector of a compressor, comprising: a compressor that compresses and supplies a flammable refrigerant to a refrigeration cycle of a refrigerator; a brushless DC motor that drives the compressor; a switching circuit that supplies drive signals to the brushless DC motor; control means that PWM-controls the switching circuit; duty measuring means that measures the duty value of a PWM signal in the control means; first duty determining means that determines whether or not the duty value measured by the duty measuring means exceeds a duty variation width where a duty value measured at a first duty measurement reference time is used as a reference; second duty determining means that determines whether or not a time rate-of-change per unit time of a duty value measured at a second duty measurement reference time by the duty measuring means exceeds a duty reference rate-of-change; and refrigerant leak determining means which determines that the flammable refrigerant is leaking when it is determined in the first duty determining means that the duty variation width has been exceeded and it is determined in the second duty determining means that the duty reference rate-of-change has not been exceeded or which determines that the flammable refrigerant is not leaking when it is determined in the first duty determining means that the duty variation width has been exceeded and it is determined in the second duty determining means that the duty reference rate-of-change has been exceeded.

The invention of claim 6 is the refrigerant leak detector of a compressor of claim 5, wherein the first duty measurement reference time and the second duty measurement reference time are set to different times.

The invention of claim 7 is a refrigerant leak detector of a compressor, comprising: a compressor that compresses and supplies a flammable refrigerant to a refrigeration cycle of a refrigerator; a brushless DC motor that drives the compressor; a switching circuit that supplies drive signals to the brushless DC motor; control means that PWM-controls the switching circuit; direct-current power supplying means that supplies drive-use direct-current power to the switching circuit; drive value measuring means that measures drive values such as voltage, current and power relating to the direct-current power supplied by the direct-current power supplying means; first drive value determining means that determines whether or not the drive value measured by the drive value measuring means exceeds a drive value variation width where a drive value measured at a first drive value measurement reference time is used as a reference; second drive value determining means that determines whether or not a time rate-of-change per unit time of a drive value measured at a second drive value measurement reference time by the drive value measuring means exceeds a drive value reference rate-of-change; and refrigerant leak determining means which determines that the flammable refrigerant is leaking when it is determined in the first drive value determining means that the drive value variation width has been exceeded and it is determined in the second drive value determining means that the drive value reference rate-of-change has not been exceeded or which determines that the flammable refrigerant is not leaking when it is determined in the first drive value determining means that the drive value variation width has been exceeded and it is determined in the second drive value determining means that the drive value reference rate-of-change has been exceeded.

The invention of claim 8 is the refrigerant leak detector of a compressor of claim 7, wherein the first drive value measurement reference time and the second drive value measurement reference time are set to different times.

In the inventions of claims 1 and 2, it is determined that the flammable refrigerant is leaking when it is determined in the duty determining means that the duty variation width has been exceeded and it is determined in the drive value determining means that the drive value reference rate-of-change has not been exceeded. In contrast, it is determined that there is a variation in the duty value resulting from the direct-current power supplying means and that the flammable refrigerant is not leaking when the drive value measuring the drive value reference rate-of-change has been exceeded.

In the inventions of claims 3 and 4, it is determined that the flammable refrigerant is leaking when it is determined in the duty determining means that the duty time rate-of-change has been exceeded and it is determined in the drive value determining means that the drive value variation width has not been exceeded. In contrast, it is determined that there is a variation in the duty value resulting from a variation in the direct current and that the flammable refrigerant is not leaking when the measured drive value exceeds the drive value variation width.

In the inventions of claims 5 and 6, it is determined that the flammable refrigerant is leaking when it is determined in the first duty determining means that the duty variation width has been exceeded and it is determined in the second duty determining means that the duty reference rate-of-change has not been exceeded. In contrast, it is determined that the flammable refrigerant is not leaking when it is determined in the first duty determining means that the duty variation width has been exceeded and it is determined in the second duty determining means that the duty reference rate-of-change has been exceeded.

In the inventions of claims 7 and 8, it is determined that the flammable refrigerant is leaking when it is determined in the first drive value determining means that the drive value variation width has been exceeded and it is determined in the second drive value determining means that the drive value reference rate-of-change has not been exceeded. In contrast, it is determined that the flammable refrigerant is not leaking when it is determined in the first drive value determining means that the drive value variation width has been exceeded and it is determined in the second drive value determining means that the drive value reference rate-of-change has been exceeded.

Figure 6:
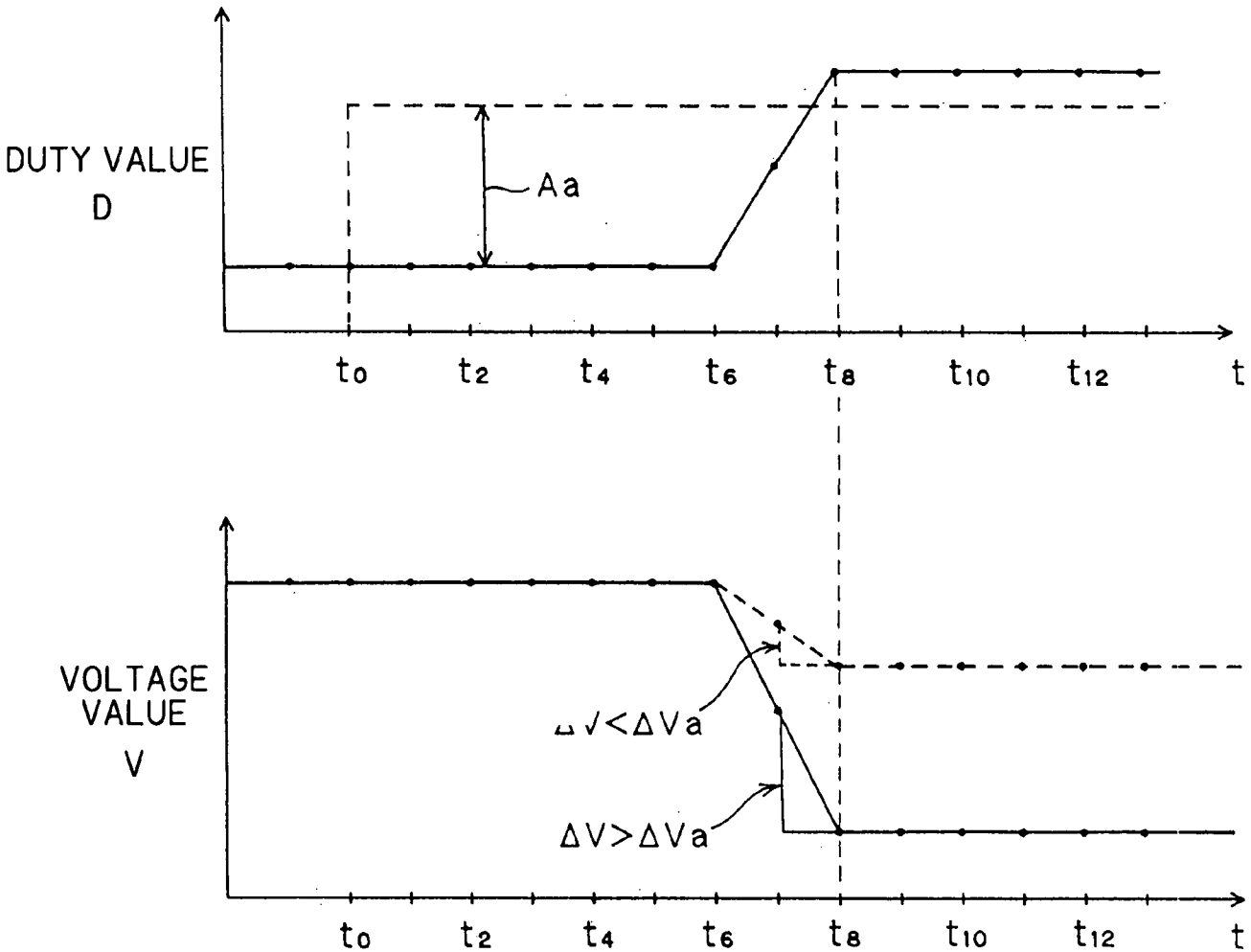

The upper part of FIG. 6 is a graph showing the relationship between the duty value D(t) and time, and the lower part of FIG. 6 is a graph showing the relationship between the voltage value V(t) of direct-current power and time.

Figure 7:
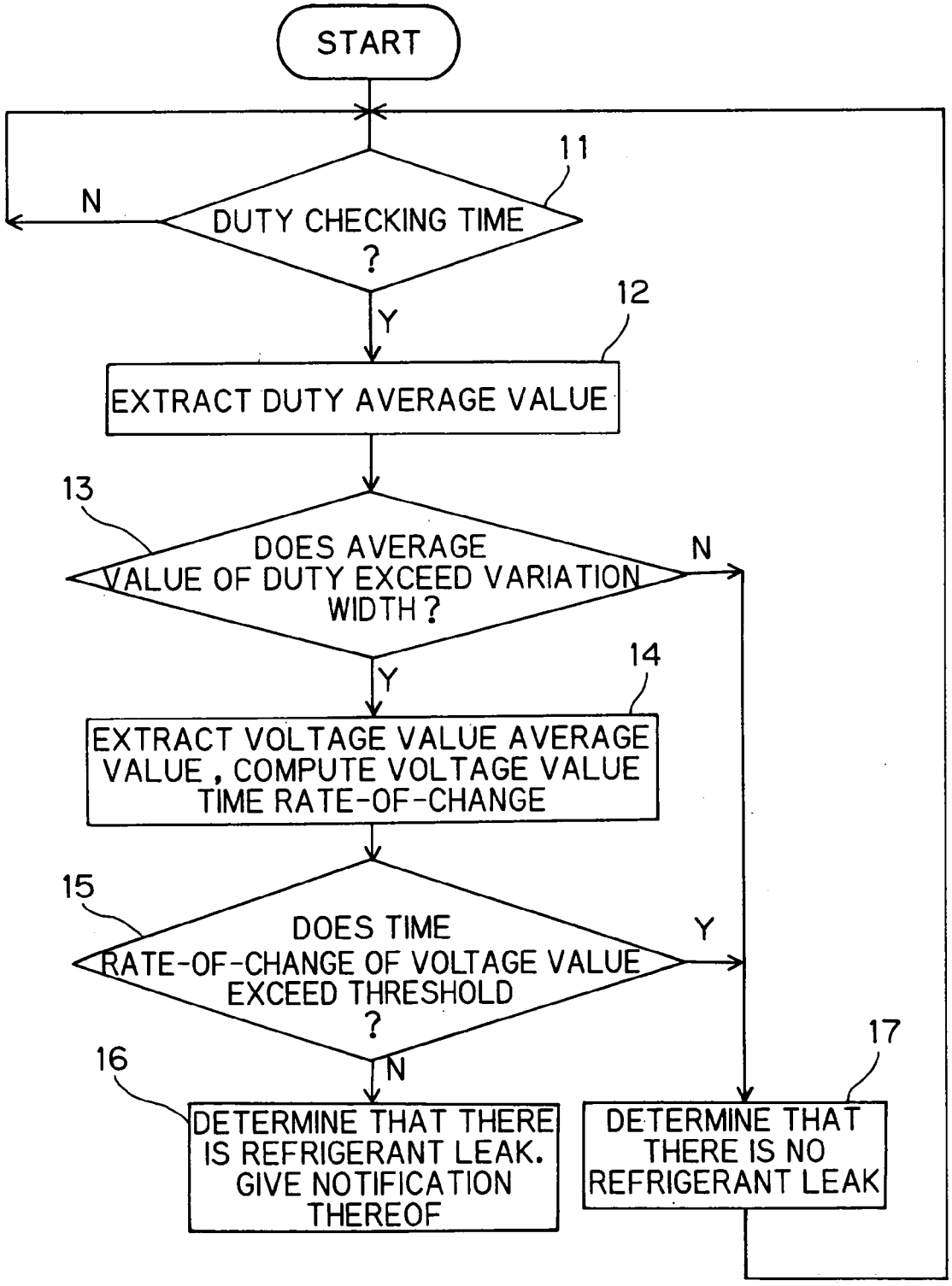

FIG. 7 is a flow chart of processing to determine whether or not there is a refrigerant leak.

BEST MODE FOR IMPLEMENTING THE INVENTION

An embodiment of the invention will be specifically described below with reference to the drawings.

The embodiment will be described on the basis of FIGS. 1 to 7.

(1) Structure of Refrigerator 1

Figure 1:
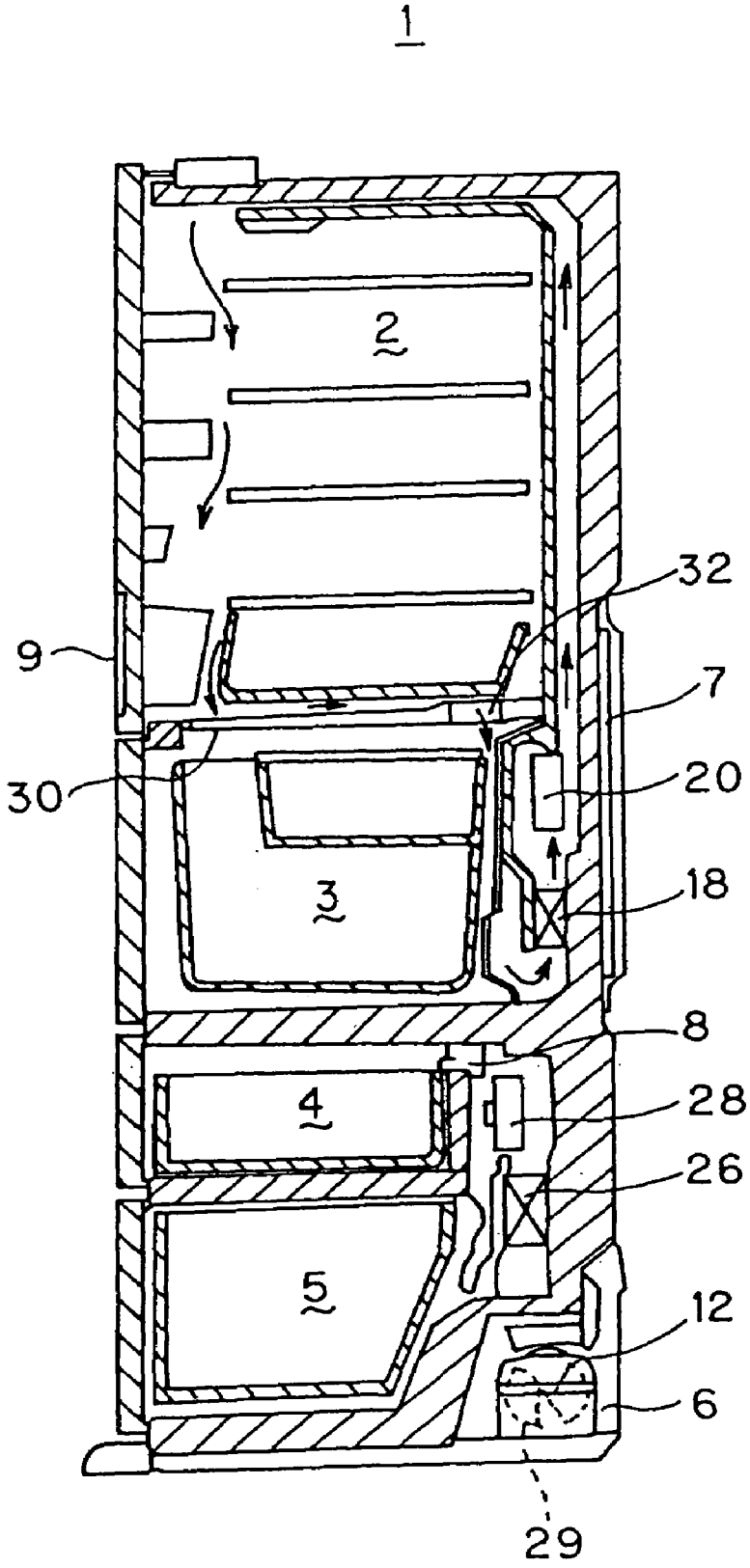
FIG. 1 is a longitudinal sectional view of a refrigerator representing an embodiment of the invention.

FIG. 1 is a cross-sectional view of a fan-type refrigerator 1 representing the embodiment.

Beginning with the upper portion, the inside of the refrigerator 1 is disposed with a refrigeration compartment 2, a vegetable compartment 3, a switching compartment 4.and a freezer compartment 5. An unillustrated ice-making compartment is also disposed next to the switching compartment 4 as part of the freezer compartment 5.

A compressor 12 and a condenser-use blower fan 29 are disposed in a machine compartment 6 at the rear of the freezer compartment 5.

A freezer compartment-use evaporator (referred to below as "F evaporator") 26 for cooling the switching compartment 4 and the freezer compartment 5 is disposed at the rear of the switching compartment 4. Also, a switching compartment-use damper 8 that adjusts the flow rate of cold air from the F evaporator 26 and adjusts the temperature inside the switching compartment 4 to a set temperature is disposed at the rear of the switching compartment 4.

A refrigeration compartment-use evaporator (referred to below as "R evaporator") 18 for cooling the refrigeration compartment 2 and the vegetable compartment 3 is disposed at the rear of the vegetable compartment 3.

A blower fan (referred to below as "F fan") 28 for blowing cold air cooled by the F evaporator 26 to the switching compartment 4 and the freezer compartment 5 is disposed above the F evaporator 26.

A blower fan (referred to below as "R fan") 20 for blowing cold air cooled by the R evaporator 18 to the refrigeration compartment 2 and the vegetable compartment 3 is disposed above the R evaporator 18.

A deodorizer 32 is disposed in a panel partitioning 30 of the refrigeration compartment 2 and the vegetable compartment 3.

A main control unit 7 comprising a microcomputer is disposed at the rear of the refrigerator 1. The main control unit 7 controls the compressor 12, the R fan 20, the F fan 28 and a later-described three-way valve 22. An operational portion 9 of the main control unit 7 is disposed in the front surface of a door to the refrigeration compartment 2.

(2) Configuration of Refrigeration Cycle 10

Figure 2:
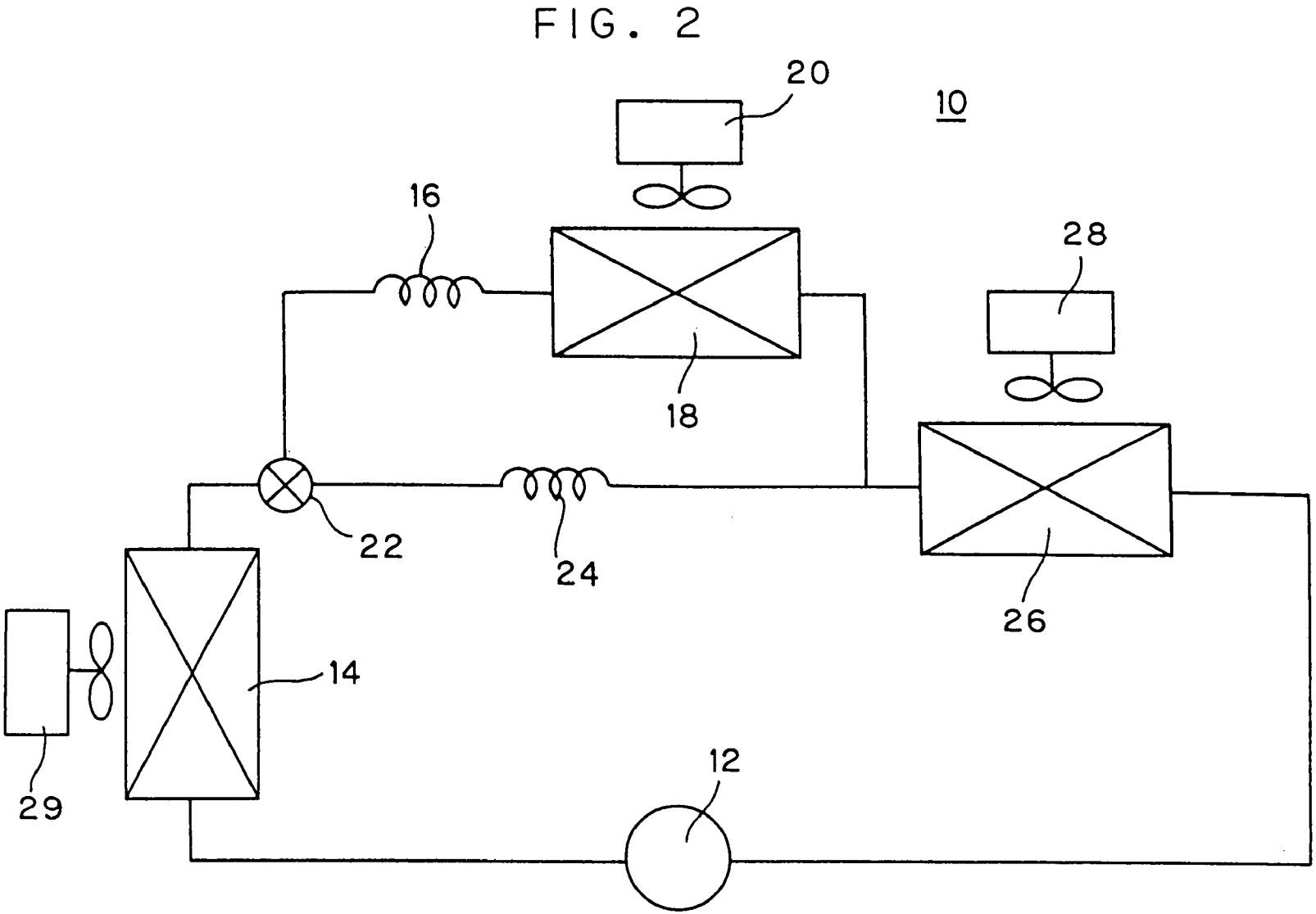
FIG. 2 is a block diagram of a refrigeration cycle of the refrigerator.

FIG. 2 shows a refrigeration cycle 10 of the refrigerator 1.

The refrigeration cycle 10 uses an R600a (isobutane) flammable refrigerant.

After the flammable refrigerant discharged from the compressor 12 passes through a condenser 14, the refrigerant flow path is switched by a refrigerant switching mechanism of the three-way valve 22.

A refrigeration capillary tube 16 and the R evaporator 18 are serially connected to one outlet of the three-way valve 22. A freezer capillary tube 24 is connected to another outlet of the three-way valve 22, merges with an outlet tube of the R evaporator 18 and is connected to an input side of the F evaporator 26. An outlet tube of the F evaporator 26 is connected to an intake side of the compressor 12.

(3) Alternate Cooling Operation

First, an alternate cooling operation of the refrigerator 1 will be described.

By "alternate cooling operation" is meant an operation where the heat of the hot refrigerant that is compressed and pressurized by the compressor 12 is released by the condenser 14, and the refrigerant emerging therefrom enters the three-way valve 22 and cools the R evaporator 18 or the F evaporator 26 to alternately conduct a refrigeration cooling mode (referred to below as "R mode") and a freezer cooling mode (referred to below as "F mode") described below.

(3-1) R Mode

In the R mode, the three-way valve 22 is switched so that the refrigerant flows through the refrigeration capillary tube 16 and is evaporated by the R evaporator 18, whereby cold air is sent by the R fan 20 to cool the refrigeration compartment 2 and the vegetable compartment 3.

(3-2) F Mode

In the F mode, the three-way valve 22 is switched and the refrigerant flow path is switched so that the refrigerant flows through the freezer capillary tube 24, is evaporated by the F evaporator 26 and returns to the compressor 12. Cold air in the F evaporator 26 is sent by the F fan 28 to the freezer compartment 5 and the like.

(3-3) Timing of the Switching between the R Mode and the F Mode

When the R mode and the F mode are alternately conducted, the switched of the modes is conducted at predetermined times, or the modes are started when the temperature inside the refrigeration compartment 2 becomes higher than an internal maximum temperature or when the temperature inside the freezer compartment 5 becomes higher than an internal maximum temperature.

Also, the compressor 12 stops when the temperature inside the refrigeration compartment 2 becomes lower than an internal minimum temperature or when the temperature inside the freezer compartment 5 becomes lower than an internal minimum temperature.

(4) Drive Configuration of the Compressor 12

The compressor 12 is a reciprocal-type compressor that is driven by a series three-phase brushless DC motor 101. A drive device 100 of the brushless DC motor (referred to below simply as "motor") 101 will be described below on the basis of FIGS. 3 and 4.

(4-1) Structure of Drive device 100

Figure 3:
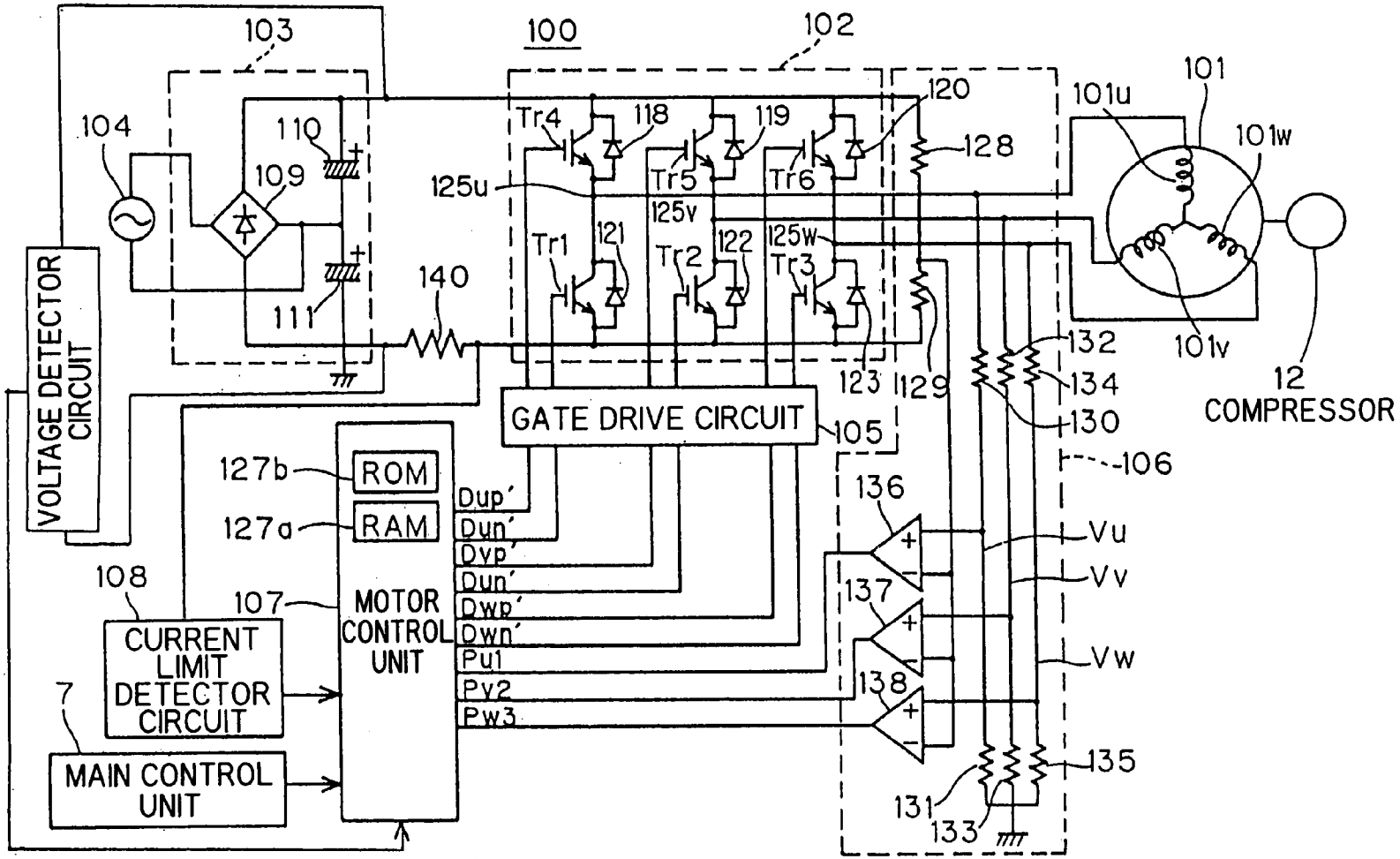
FIG. 3 is a block diagram of a drive device of a motor in the refrigerator.

The structure of the drive device 100 will be described on the basis of the circuit diagram of FIG. 3.

The drive device 100 mainly comprises a switching circuit 102, a voltage doubler rectifier circuit 103, an alternating-current power supply 104, a gate drive circuit 105, a position detector circuit 106, a motor control unit 107, a current limit detector circuit 108 and a voltage detector circuit 150.

The drive device 100 has a configuration where 280 V of direct-current power is generated by the voltage doubler rectifier circuit 103 from the alternating-current power supply 104 of 100 V of an alternating current to drive the motor 101 with the switching circuit 102.

(4-1-1) Switching Circuit 102

The switching circuit 102, which comprises a three-phase bridge driver, has the following configuration.

Two NPN-type switching transistors Tr1 and Tr4 are serially connected, and diodes 118 and 121 are connected to collector terminals and emitter terminals of the switching transistors Tr1 and Tr4, to configure one series circuit. Similarly, one series circuit is configured by the switching transistors Tr2 and Tr5 and diodes 119 and 122, and one series circuit is configured by the switching transistors Tr3 and Tr6 and diodes 120 and 123, whereby three series circuits are connected in parallel.

Stator coils 101*u, v* and *w* to which the motor 101 is Y-connected are connected to nodes 125*u*, 12*v* and 125*w* of the pairs of switching transistors Tr1 and Tr4, Tr2 and Tr5, and Tr3 and Tr6 of the series circuits.

(4-1-2) Voltage Doubler Rectifier Circuit 103

As described above, the voltage doubler rectifier circuit 103 converts the 100-V alternating current to the 280-V direct current. After full-wave rectification by a bridge circuit 109 configured by a diode, the voltage is doubled by smoothing capacitors 110 and 111.

(4-1-3) Gate Drive Circuit 105

The gate drive circuit 105 generates gate signals with power signals based on PWM signals from the motor control unit 107 and respectively outputs the gate signals to gate terminals of the six switching transistors Tr1 to Tr6 of the switching circuit 102.

(4-1-4) Position Detector Circuit 106

The position detector circuit 106 detects the drive currents flowing to the stator coils of each phase, with detection lines branching from the stator coils 101*u*, 101*v* and 101*w* of each phase. Of these, detector resistors 130 and 131 are serially connected to the detection line branching from the u phase and grounded, detector resistors 132 and 133 are serially connected to the detection line branching from the v phase and grounded, and detector resistors 134 and 135 are serially connected to the detection line branching from the detection line of the w phase and grounded.

Additionally, two resistors 128 and 130 are connected to the emitter terminals of the three switching transistors Tr1, Tr2 and Tr3 and to the collector terminals of the switching transistors Tr4, Tr5 and Tr6, and an intermediate detection line for taking a direct-current intermediate voltage-from the node of the resistors 128 and 130 is drawn out.

The intermediate voltage detection line is connected to the negative terminal of a u phase-use comparator 136, and a line for taking the voltage between the detector resistors 130 and 131 in the u phase detection line is connected to the positive terminal of the comparator 136. Similarly, with respect also to a v phase comparator 137 and a w phase comparator 138, the direct-current intermediate voltage line and the detection lines of each phase are connected to negative terminals and positive terminals.

Additionally, outputs of the three comparators 136, 137 and 138 are connected to input terminals of the motor control unit 107. Below, the outputs from the comparators will be referred to as position signals Pu1, Pv1 and Pw1.

(4-1-5) Current Limit Detector Circuit 108

The current limit detector circuit 108 detects the current flowing to a shunt resistor 140 disposed between the voltage doubler rectifier circuit 103 and the switching circuit 102, and when the current exceeds a threshold, the current limit detector circuit 108 outputs a limit instruction signal to the motor control unit 107 instructing the motor control unit 107 to limit the output.

(4-1-6) Voltage Detector Circuit 150

The voltage detector circuit 150 detects the voltage value of the direct-current voltage outputted from the voltage doubler rectifier circuit 103, and this detected voltage value is outputted to the motor control unit 107.

(4-1-7) Motor Control Unit 107

The motor control unit 107 comprising the microcomputer generates power signals by PWM control from the position signals from the position detector circuit 106, the limit instruction signal from the current limit detector circuit 108 and a speed command signal from the main control unit 7 of the refrigerator 1, and outputs the power signals to the gate drive circuit 105. Namely, the motor control unit 107 conducts inverter driving.

Also, a ROM 127*b* and a RAM 127*a* for storing data are disposed in the motor control unit 107.

(4-2) Operating Status of the Drive device 100

The operating status of the drive device 100 will be described-on the basis of FIGS. 3 and 4.

Position detection of a rotor of the motor 101 is conducted by a method that detects induced voltage generated in a non-conducting phase in a 120° conductive square wave drive method. The voltage based on the drive current of the stator coils 101*u*, 101*v* and 101*w* of the motor 101 and the intermediate voltage of the 280-V direct current are respectively partially pressurized, compared in the comparators 136 to 138 and inputted to the motor control unit 107 as position signals Pu1. Pv1 and Pw1.

These position signals Pu1, Pv1 and Pw1 become reference signals that rotate the motor 101. Inside the motor control unit 107, as shown in the waveform diagram of FIG. 4, these signals are phase-shifted 30° on the basis of the position signals Pu1, Pv1 and Pw1 of the comparators 136 to 138 to generate corrected position signals Pu2, Pv2 and Pw2. These phase-corrected position signals are logic-converted to generate power signals. The PWM signals are omitted from FIG. 4, but they are synthesized with the PWM signals of the highside, i.e., the upstream side switching transistors, and power signals based on the PWM signals are outputted so that the voltage is adjusted to adjust the rotational frequency.

Figure 4:
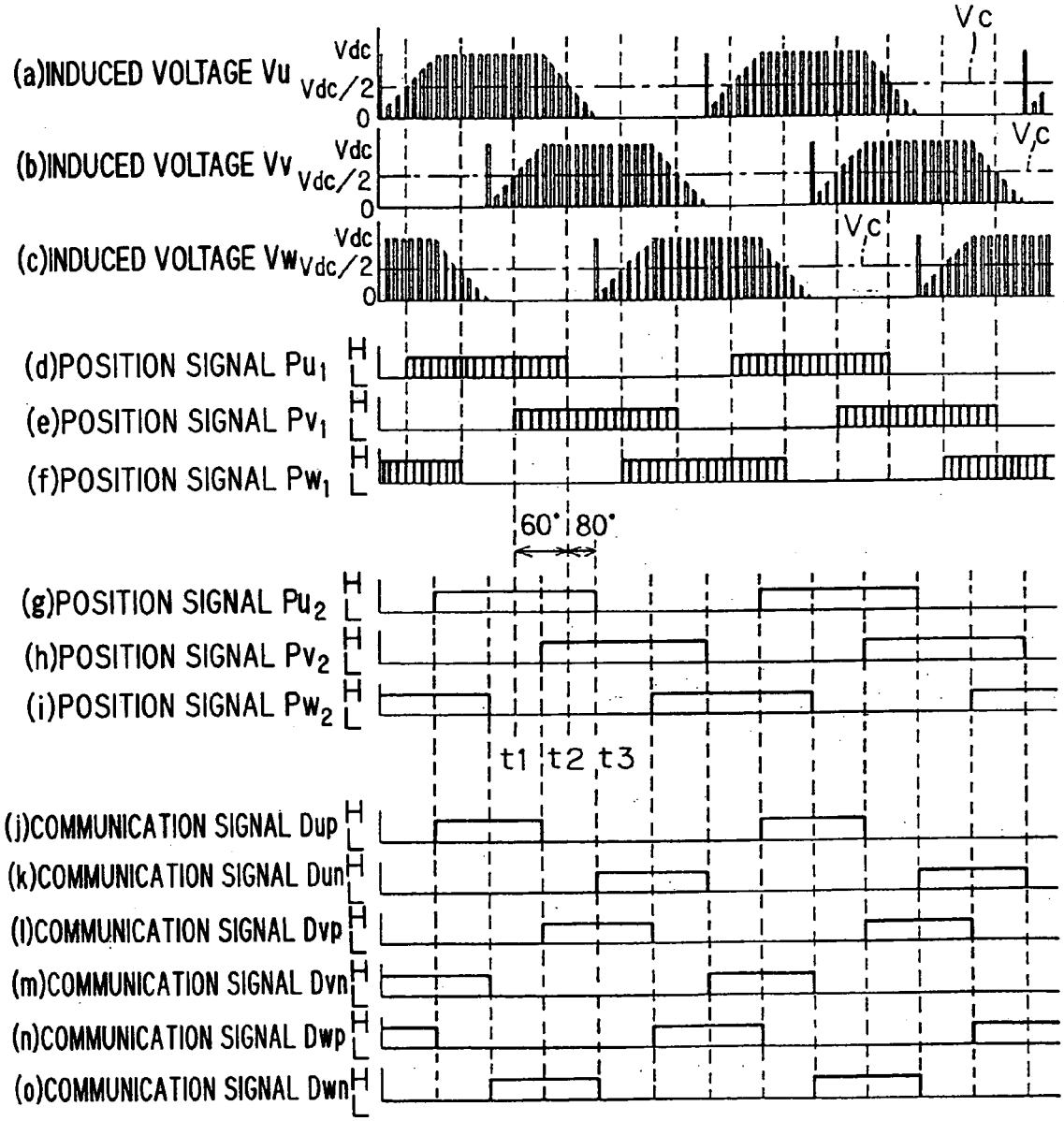
FIG. 4 is a waveform diagram of signals in the drive device.

When position detection is conducted, as shown in (a) to (d) of FIG. 4, because the signals change from high to low or from low to high per electrical angle of 60°, the time thereof is measured each time, and half of that time is phase-shifted as a 30° electrical angle, i.e., commutation is conducted.

Moreover, the current limit in the current limit detector circuit 108 is converted to a voltage by the shunt resistor 140 and compared with the reference voltage in a comparator inside the current limit detector circuit 108, and when the current is higher than a threshold, the motor control unit 107 cuts the ON period of the PWM signals.

(5) Configuration of Flammable Refrigerant Leak Detection

Detection of flammable refrigerant leaks is also conducted in the motor control unit 107 of the drive device 100. The configuration by which flammable refrigerant leaks are detected will be described.

First, before this configuration is described, the theory of detecting flammable refrigerant leaks will be described.

(5-1) Regarding Changes in the Duty Value when the Flammable Refrigerant Leaks

When the flammable refrigerant leaks, the position of the leak differs greatly between the high voltage side and the low voltage side of the refrigeration cycle 10. In other words, when the inside of the refrigerator is cooled to a normal temperature, the F evaporator 26 becomes equal to or less than −11° C. (1 atm), which is the boiling point of isobutane at −18° C. to −26° C. The R evaporator 18 also approaches the boiling point temperature during the cooling time of the refrigeration compartment 2. Thus, when a pinhole or crack arises in the F evaporator 26 or the R evaporator 18 which are inside the refrigerator (low voltage side), the refrigerant almost never flows out into the atmosphere at the time of the startup operation, but rather the outside air is sucked into the refrigeration cycle. On the other hand, because the refrigerant pressure becomes higher than atmospheric pressure, at the high voltage side, the refrigerant soon leaks out from the place where the hole is due to the same kind of pinhole or crack, and the refrigerant pressure in the refrigerant flow path drops.

In order to reliably determine refrigerant leakage in a situation where there is a flammable refrigerant leak or when there is the potential for a leak to arise, determination methods corresponding to each of the high pressure side and the low pressure side of the refrigeration cycle 10 become necessary. For this reason, in consideration of this point, determination of refrigerant leakage is conducted with the duty value for conducting control of the compressor 12.

As described above, the motor control unit 107 controls the motor 101 with the PWM signals, and the duty value of the compressor 12 is the ratio of the ON period and the OFF period of the PWM signals. For example, when the duty value is 100%, the motor 101 is at full power because the ON period is 100%. When the duty value is 50%, the motor 101 is at half power because the ON period is 50%. When the duty value is 0%, the motor 101 is stopped because the ON period is zero.

The duty value is dependent on the rotational frequency and load of the motor 101, but even if the load is constant, the duty value changes depending on the operating frequency (rotational frequency), and the degree of the change in the duty value with respect to the change in the load changes depending on the operating frequency. However, by using an optional duty value as a reference and computing a variation width from this reference duty value, the load variation can be observed without relation to the operating frequency.

Namely, this is defined by the following equation (1).

$$A(t)=D(t0)-D(t) \quad (1)$$

Here, A(t) is the duty variation width in a checking time t, D(t0) is the duty value in a duty measurement reference time t0, and D(t) is the duty value in the detection time t.

Because there is a constant relation between the load of the compressor 12 and the duty variation width A(t), it can be determined that there is a refrigerant leak when the computed duty variation width A(t) exceeds a predetermined reference duty variation width Aa.

With respect to the way the reference duty value D(t0) is taken, a duty value D(t0) of a time t0 at which the duty value D(t) changes without relation to refrigerant leakage when there is a change in the behavior of the refrigeration cycle 10 or after the operating frequency of the compressor 12 is switched serves as the reference duty value. The details will be described later.

As described above, the behavior of the refrigerator cycle 10 differs when a refrigerant leak arises at the low voltage side and the high voltage side. For example, when a leakage place such as a crack arises in the R evaporator 18 or the F evaporator 26, which are the low voltage side, the refrigeration cycle 10 sucks air in due to the pressure differential with the atmosphere, and the pressure inside the refrigeration cycle 10 rises. Then, in accordance with the rise in pressure, a load is applied to the compressor 12 and the duty value D(t) rises.

In contrast, when a leak arises at the high voltage side, the refrigerant soon leaks because the refrigerant pressure is larger than atmospheric pressure. For this reason, the amount of refrigerant in the refrigerant flow path decreases and the load of the compressor 12 decreases. Thus, the duty value D(t) of the compressor 12 decreases.

(5-2) Relationship between Duty Value and Variations in the Voltage Value of the Direct-Current Power Supply As described above, the duty value changes when a refrigerant leak arises. The duty value also changes in other instances when the voltage value of the direct-current power supply varies.

The correlation between the 280-V direct current, which is the output from the voltage doubler rectifier circuit 103, and the duty value is such that the duty value increases when the voltage value decreases, and the duty value decreases when the voltage value increases.

Thus, in the present embodiment, refrigerant leak detecting means that ensures that variations in the duty value resulting from variations in the output value of the voltage doubler rectifier circuit 103, i.e., the voltage value of the direct-current power are not erroneously detected as a refrigerant leak will be described below with attention given to this correlation.

(5-3) Nature of Refrigerant Leak Detection

A specific example of the nature of refrigerant leak detection will be described on the basis of FIGS. 5 to 7.

Figure 5:
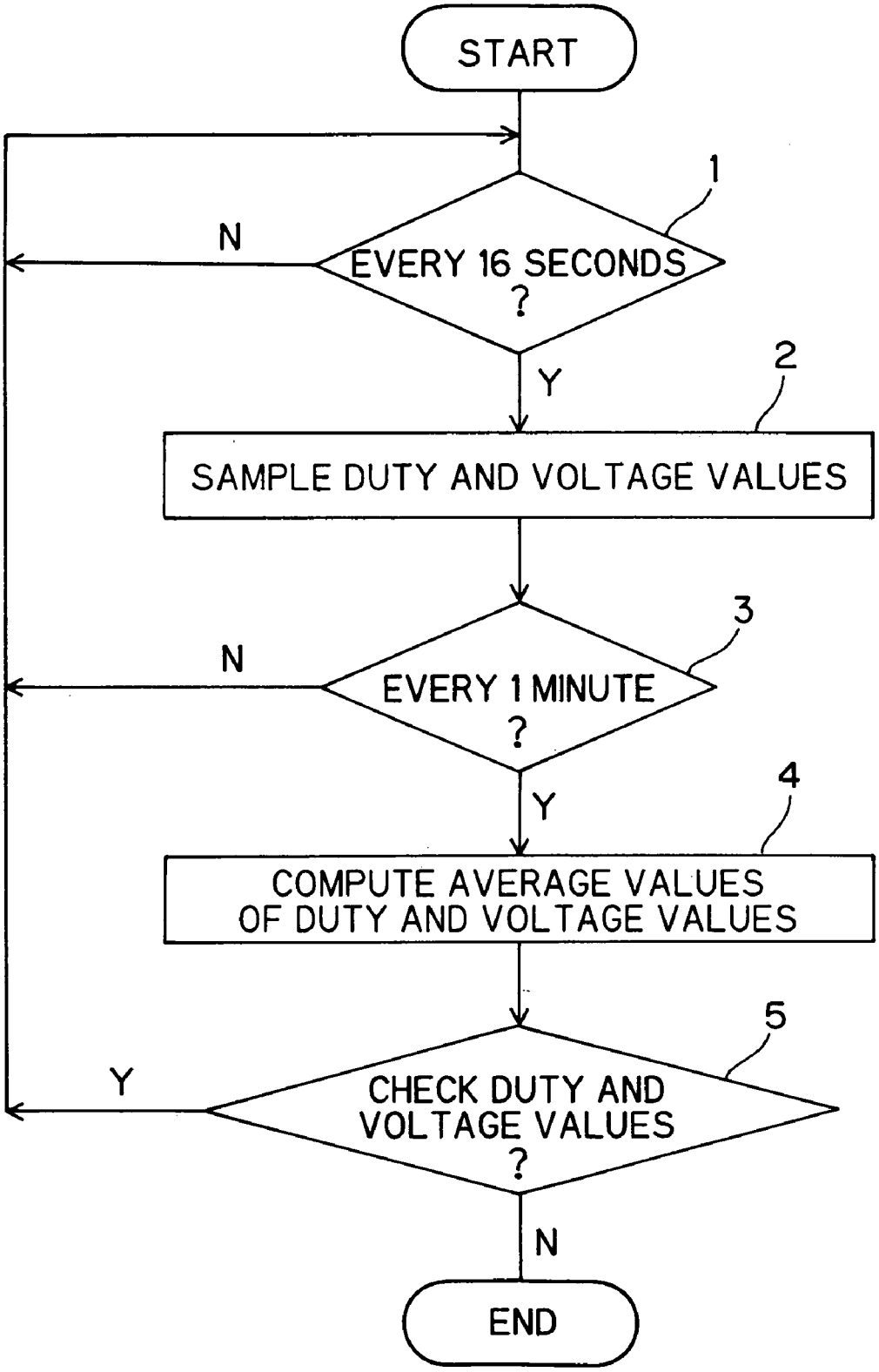
FIG. 5 is a flow chart showing the detection of a duty value D(t) and a voltage value V(t).

(5-3-1) Measurement of the Duty Value D(t) and the Voltage Value V(t) of the Direct-Current Power FIG. 5 is a flow chart for conducting measurement of the duty value D(t) and the voltage value V(t) of the direct-current power supply. Description will be given below on the basis of this flow chart.

In step 1, measurement of the duty value D(t) and the current value is conducted every 16 seconds. The process proceeds to step 2 if 16 seconds has elapsed and continues counting for 16 seconds if 16 seconds has not elapsed.

In step 2, sampling of the duty value D(t) and the voltage value V(t) is conducted. Because the duty value D(t) of the PWM signals presently being outputted is understood in the motor control unit 107, this duty value D(t) is sampled or the motor control unit 107 samples the present voltage value V(t) on the basis of the output from the voltage detector circuit 150. Then, the process proceeds to step 3.

In step 3, in order to calculate average values during 1 minute, it is determined whether or not 1 minute has elapsed. The process returns to step 1 if 1 minute has not elapsed or proceeds to step 4 if 1 minute has elapsed.

In step 4, the average values of the duty value D(t) and the voltage value V(t) measured during 1 minute are respectively computed. Namely, because the duty value D(t) and the voltage value V(t) are sampled every 16 seconds, sampling can be done three times in 1 minute. The average values of the duty values D(t) and voltage values V(t) of those three times are respectively computed, and the process proceeds to step 5.

In step 5, the process returns to step 1 if sampling of the duty value D(t) and the voltage value V(t) is to be continued, and the process ends if sampling is to be stopped.

With this processing, the duty value D(t) and the voltage value V(t) can be sampled every 16 seconds, and the average values of a 1-minute interval can be computed. The sampling of the duty value D(t) and the voltage value V(t) always continues without relation to the driving state of the compressor 12. Additionally, this processing ends when the power is turned OFF.

(5-3-2) Refrigerant Leak Detection

Next, refrigerant leak detection will be described on the basis of the graphs of FIG. 6 and the flow chart of FIG. 7.

FIG. 6 is an explanation in a case where a refrigerant leak has arisen at the low voltage side, the duty value D(t) has risen and the voltage value V(t) has dropped. The upper graph in FIG. 6 shows temporal changes in the duty value D(t), and the average values of the duty value D(t) every 1 minute as described above are represented by black circles. The lower graph in FIG. 6 shows temporal changes in the voltage value V(t), and the average values of the voltage value V(t) during 1 minute are represented by black circles.

(5-3-2-1) Storage of Reference Duty Value

In the measurement of the duty value D(t) and the voltage value V(t) of the direct-current power of FIG. 5, when there is a change described below, the time of that change is used as the duty measurement reference time t0, the duty value D(t0) at that time t0 is used as the reference duty value, the motor control unit 107 stores these in the RAM 127*a*, and the values thereof are updated each time there is a change.

As the change, the following cases are conceivable.

The mode has been switched from the R mode to the F mode

The mode has been switched from the F mode to the R mode

The operating frequency of the compressor 12 has changed

The compressor 12 has been activated (5-3-2-2) Processing when a Refrigerant Leak Arises at the Low Voltage Side Processing when a refrigerant leak arises at the low voltage side will be described on the basis of FIG. 7.

In step 11, it is determined whether or not a refrigerant leak has arisen at the checking time of the duty value D(t). The checking of the duty value D(t) is conducted every 1 minute.

In step 12, the average value of the duty values D(t) at the checking times t computed in the flow chart of FIG. 6 is extracted.

In step 13, it is determined whether or not the average value of the duty value D(t) has risen and the duty variation width A(t) described above exceeds the reference duty variation width Aa. If the duty variation width A(t) does not exceed the reference duty variation width Aa, it is determined in step 17 that there is no refrigerant leak. If the duty variation width A(t) exceeds the reference duty variation width Aa, it is determined that there is the possibility of a refrigerant leak and the process proceeds to step 14.

In step 14, the average value of the voltage values V(t) at the checking times t is extracted, the average value of the voltage value V(t−1) of a unit time prior to the testing time (specifically, 1 minute prior) is extracted, and a time rate-of-change Δ V per unit time (per 1 minute) is computed.

In step 15, in a case where the voltage value V(t) has dropped and the time rate-of-change ΔV exceeds a voltage value reference rate-of-change ΔVa as represented by the solid line in the lower graph of FIG. 6, i.e., in a case where ΔV>ΔVa, the direct-current power (output of the voltage doubler rectifier circuit 103) varies, it is determined that there is no refrigerant leak, and the process proceeds to step 17. In the graphs of FIG. 6, the time t8 serves as the measurement reference time. On the other hand, in a case where the time rate-of-change ΔV of the voltage value V(t) does not exceed the voltage value reference rate-of-change ΔVa as represented by the dotted line in the lower graph of FIG. 6, it is determined that there is a refrigerant leak, and the process proceeds to step 16.

In step 16, it is determined that there is a refrigerant leak, and the motor control unit 107 outputs a refrigerant leak detection signal to the main control unit 7, stops all driving of the refrigerator 1 and notifies the user thereof.

Due to the above, because not only the duty variation width of the duty value D(t) but also the time rate-of-change ΔV of the voltage value V(t) are detected, refrigerant leak determination can be precisely conducted without erroneously determining variations in the duty value D(t) resulting from variations in the direct-current power to be a refrigerant leak.

Also, the duty measurement reference time of the duty value D(t) is at t0 and the measurement reference time t8 at which the time rate-of-change of the voltage value V(t) is checked is at t8. By making the measurement reference times different in this manner, refrigerant leaks can be detected.

(5-3-2-3) Processing when a Refrigerant Leak Arises at the High Voltage Side

In FIG. 5, a case was described where there was a refrigerant leak at the low voltage side and the duty value D(t) rose and the voltage value V(t) dropped, but detection is similarly possible even in a case where there is a refrigerant leak at the high voltage side and the duty value D(t) has dropped and the voltage value V(t) has risen.

MODIFIED EXAMPLE 1

The duty variation width A in the above embodiment was defined by equation (1), but it may also be defined as in the following equation (2) instead.

$$A(t)=(D(t0)-D(t))/D(t0) \quad (2)$$

Here, A(t) is the duty variation width in the detection time t, D(t0) is the duty value at the duty measurement reference time t0, and D(t) is the duty value at the detection time t.

MODIFIED EXAMPLE 2

In the preceding embodiment, the duty value D(t) was detected with the duty variation width A and the voltage value V(t) was detected with the time rate-of-change ΔV, but the duty value D(t) may be detected with a time rate-of-change ΔD and the voltage value V(t) may be detected with a voltage value variation width instead.

Additionally, it was determined that there was a refrigerant leak when the time rate-of-change of the duty value D(t) exceeded the threshold and the voltage value variation width did not exceed the threshold, but it may be determined that there is no refrigerant leak when the time rate-of-change AD of the duty value D(t) exceeds the threshold and the voltage value variation width exceeds the threshold.

MODIFIED EXAMPLE 3

Also, the time rate-of-change and the duty variation width of the duty value D(t) may be detected to determine whether or not there is a refrigerant leak.

Namely, it is determined that there is a refrigerant leak when the time rate-of-change of the duty value D(t) exceeds the threshold and the duty variation width does not exceed the threshold, and it is determined that there is no refrigerant leak when the time rate-of-change ΔD of the duty value D(t) exceeds the threshold and the duty variation width exceeds the threshold.

MODIFIED EXAMPLE 4

Also, the voltage value variation width and the time rate-of-change ΔV of the voltage value V(t) may be detected at the same time to determine whether or not there is a refrigerator leak.

Namely, it is determined that there is a refrigerant leak when the time rate-of-change of the voltage value V(t) exceeds the threshold and the duty variation width does not exceed the threshold, and it is determined that there is no refrigerant leak when the time rate-of-change ΔV of the voltage value V(t) exceeds the threshold and the voltage value variation width exceeds the threshold.

MODIFIED EXAMPLE 5

In the preceding embodiment, the time rate-of-change ΔV of the voltage value V(t) detected by the voltage detector circuit 150 was used, but refrigerant leak determination may also be conducted by control similar to the above on the basis of a time rate-of-change ΔI of the current value and the current value variation width detected by the current limit detector circuit 108 instead.

Also, determination may be done with a power value P(t)=V(t)×I(t), where the voltage value V(t) detected by the voltage detector circuit 150 is multiplied by a current value I (t) detected by the drive current limit detector circuit 108.

INDUSTRIAL APPLICABILITY

As described above, according to the present invention, in a case where the change in the duty value is large and the change in the voltage value is large, it is determined that the change in the duty value is a change based on a change in the direct-current power supply and not a change resulting from a refrigerant leak, whereby erroneous detection of a refrigerant leak is not conducted.

Additionally, by using a refrigerant leak detector of a compressor in a refrigerator, detection of refrigerant leaks in the refrigerator can be reliably conducted.

The invention claimed is:

1. A refrigerant leak detector of a compressor, comprising:

a compressor that compresses and supplies a flammable refrigerant to a refrigeration cycle of a refrigerator;

a brushless DC motor that drives the compressor;

a switching circuit that supplies drive signals to the brushless motor;

control means that PWM-controls the switching circuit;

direct-current power supplying means that supplies drive-use direct current power to the switching circuit;

duty measuring means that measures the duty value of a PWM signal in the control means;

drive value measuring means that measures drive values including voltage, current and power relating to the direct-current power supplied by the direct-current power supplying means;

duty determining means that determines whether or not the duty value measured by the duty measuring means exceeds a duty variation width where the duty value measured at a duty measurement reference time is used as a reference;

drive value determining means that determines whether or not a time rate-of-change per unit time of the drive value measured at the drive value measurement reference time by the drive value measuring means exceeds a drive value reference rate-of-change; and refrigerant leak determining means which determines that the flammable refrigerant is leaking when it is determined in the duty determining means that the duty variation width has been exceeded and it is determined in the drive value determining means that the drive value reference rate-of-change has not been exceeded or which determines that the flammable refrigerant is not leaking when it is determined in the duty determining means that the duty variation width has been exceeded and it is determined in the drive value determining means that the drive value reference rate-of-change has been exceeded.

2. The refrigerant leak detector of a compressor of claim 1, wherein the duty measurement reference time and the drive value measurement reference time are set to different times.

3. A refrigerant leak detector of a compressor, comprising:

a compressor that compresses and supplies a flammable refrigerant to a refrigeration cycle of a refrigerator;

a brushless DC motor that drives the compressor;

a switching circuit that supplies drive signals to the brushless DC motor;

control means that PWM-controls the switching circuit;

direct-current power supplying means that supplies drive-use direct current power to the switching circuit;

duty measuring means that measures the duty value of a PWM signal in the control means;

drive value measuring means that measures drive values including voltage, current and power relating to the direct-current power supplied by the direct-current power supplying means;

duty determining means that determines whether or not a time-of-rate change per unit time of the duty value measured at a duty measurement reference time by the duty measuring means exceeds a duty reference rate-of-change;

drive value determining means that determines whether or not the drive value measured by the drive value measuring means exceeds a drive value variation width where a drive value measured at a drive value measurement reference time is used as a reference; and refrigerant leak determining means which determines that the flammable refrigerant is leaking when it is determined in the duty determining means that the duty time rate-of-change has been exceeded and it is determined in the drive value determining means that the drive value variation width has not been exceeded or which determines that the flammable refrigerant is not leaking when it is determined in the duty determining means that the duty time rate-of-change has been exceeded and it is determined in the drive value determining means that the drive value variation width has been exceeded.

4. The refrigerant leak detector of a compressor of claim 3, wherein the duty measurement reference time and the drive value measurement reference time are set to different times.

5. A refrigerant leak detector of a compressor, comprising:

a compressor that compresses and supplies a flammable refrigerant to a refrigeration cycle of a refrigerator;

a brushless DC motor that drives the compressor;

a switching circuit that supplies drive signals to the brushless DC motor;

control means that PWM-controls the switching circuit;

duty measuring means that measures the duty value of a PWM signal in the control means;

first duty determining means that determines whether or not the duty value measured by the duty measuring means exceeds a duty variation width where a duty value measured at a first duty measurement reference time is used as a reference;

second duty determining means that determines whether or not a time rate-of-change per unit time of a duty value measured at a second duty measurement reference time by the duty measuring means exceeds a duty reference rate-of-change; and refrigerant leak determining means which determines that the flammable refrigerant is leaking when it is determined in the first duty determining means that the duty variation width has been exceeded and it is determined in the second duty determining means that the duty reference rate-of-change has not been exceeded or which determines that the flammable refrigerant is not leaking when it is determined in the first duty determining means that the duty variation width has been exceeded and it is determined in the second duty determining means that the duty reference rate-of-change has been exceeded.

6. The refrigerant leak detector of a compressor of claim 5, wherein the first duty measurement reference time and the second duty measurement reference time are set to different times.

7. A refrigerant leak detector of a compressor, comprising:

a compressor that compresses and supplies a flammable refrigerant to a refrigeration cycle of a refrigerator;

a brushless DC motor that drives the compressor;

a switching circuit that supplies drive signals to the brushless DC motor;

control means that PWM-controls the switching circuit;

direct-current power supplying means that supplies drive-use direct-current power to the switching circuit;

drive value measuring means that measures drive values including voltage, current and power relating to the direct-current power supplied by the direct-current power supplying means;

first drive value determining means that determines whether or not the drive value measured by the drive value measuring means exceeds a drive value variation width where a drive value measured at a first drive value measurement reference time is used as a reference;

second drive value determining,means that determines whether or not a time rate-of-change per unit time of a drive value measured at a second drive value measurement reference time by the drive value measuring means exceeds a drive value reference rate-of-change; and refrigerant leak determining means which determines that the flammable refrigerant is leaking when it is determined in the first drive value determining means that the drive value variation width has been exceeded and it is determined in the second drive value determining means that the drive value reference rate-of-change has not been exceeded or which determines that the flammable refrigerant is not leaking when it is determined in the first drive value determining means that the drive value variation width has been exceeded and it is determined in the second drive value determining means that the drive value reference rate-of-change has been exceeded.

8. The refrigerant leak detector of a compressor of claim 7, wherein the first drive measurement reference time and the second drive value measurement reference time are set to different times.

* * * * *